US009937432B1

(12) United States Patent
Renes et al.

(10) Patent No.: US 9,937,432 B1
(45) Date of Patent: Apr. 10, 2018

(54) KIT FOR PROVIDING A COLORABLE BALLOON

(71) Applicant: Ballon Service Renes V.O.F., Beesd (NL)

(72) Inventors: Henk Renes, Beesd (NL); Raymond Renes, Beesd (NL)

(73) Assignee: BALLON SERVICE RENES V.O.F., Beesd (NL)

( * ) Notice: Subject to any disclaimer, the term of this patent is extended or adjusted under 35 U.S.C. 154(b) by 0 days.

(21) Appl. No.: 15/433,732

(22) Filed: Feb. 15, 2017

(51) Int. Cl.
*A63H 27/10* (2006.01)
*A63H 5/00* (2006.01)

(52) U.S. Cl.
CPC ..... *A63H 27/10* (2013.01); *A63H 2027/1025* (2013.01); *A63H 2027/1075* (2013.01)

(58) Field of Classification Search
CPC ..... A63H 27/00; A63H 27/10; A63H 2027/1041; A63H 2027/1075; A63H 2027/1033; A63H 2027/1083; A63H 5/00
USPC ..... 446/220–226
See application file for complete search history.

(56) References Cited

U.S. PATENT DOCUMENTS

| | | | | |
|---|---|---|---|---|
| 6,136,078 | A | 10/2000 | Craig | |
| 6,663,455 | B1 * | 12/2003 | Lang | A63H 27/10 206/459.5 |
| 2005/0153622 | A1 | 7/2005 | Hwang | |
| 2007/0249259 | A1 * | 10/2007 | Pham | A63H 5/00 446/224 |
| 2014/0038490 | A1 * | 2/2014 | Smith | A63H 27/10 446/223 |

FOREIGN PATENT DOCUMENTS

| | | | |
|---|---|---|---|
| CN | 2275895 | Y | 3/1998 |
| GB | 2318546 | A | 4/1998 |
| WO | WO 2013/083261 | A1 | 6/2013 |

* cited by examiner

*Primary Examiner* — Kien Nguyen
(74) *Attorney, Agent, or Firm* — Knobbe Martens Olson & Bear LLP

(57) ABSTRACT

The current invention provides a kit of playing materials. The kit includes an inflatable foil, which is suitable for receiving and containing a gas and for forming a balloon. The foil has a colorable area, which covers the foil at least partially. The kit also includes a set of wax-based coloring agents, which can be applied directly onto the foil. Due to the light-weight properties of the foil, the balloon is floating in the air when filled with helium. In a second aspect, the present invention provides a method for providing one or more colorable balloons.

14 Claims, 1 Drawing Sheet

KIT FOR PROVIDING A COLORABLE BALLOON

TECHNICAL FIELD

The invention pertains to the technical field of coloring sheets and, more particularly, to the coloring of a foil balloon used as playing materials.

BACKGROUND

Conventional balloons are made chiefly of rubber or synthetic resin in the form of variously shaped, hollow bags inflated with air or gas, and generally used as playing materials, i.e., toys. Because they are so often used as toys by kids, people in the past have looked for ways to further improve the playing experience. A suggestion that has been proposed are the provision of colorable balloons. However, conventional balloons are difficult to use for purposes related to coloring because the surface of the balloon is not easily colored with crayons or paints after fabrication. The surface of the balloon is merely colored or printed during fabrication.

Some solutions have been proposed in the past to overcome that problem.

U.S. Pat. No. 7,335,083 for instance describes an inflatable sheet type balloon with a surface that can be colored with crayons or paints. However, said colorable area comprises a paper layer adhered to the exterior surface of said balloon body. Due to the high specific weight or density of the combination of a sheet balloon with a paper layer, these balloons are not able to float in the air when filled with helium. This is a considerable disadvantage for this type of balloons.

U.S. Pat. No. 5,928,050 describes a toy kit comprising a stretchable container such as latex or rubber, which can be partly filled with an edible or other shape retaining substance. The container has surface properties to allow marking on the surface with a normal colored marker. Nevertheless, latex and rubber balloons are considered of less quality when compared to foil balloons, which are stronger and more luxurious. Moreover, once the container is filled with material, seams originate in the wall of the balloon. These seams are hard to color efficiently, which is another drawback.

U.S. Pat. No. 1,720,594 describes a process for coloring toy balloons manufactured from rubber or latex. According to this process, arbitrary shapes are colored by a colorant.

However, it is not possible with the latter technique to color figures or regular forms. The drawbacks related to the use of rubber or latex are described above.

CN 101 314 929 discloses water-based paint for coloring on inner lining paper of colorful aluminum foil. Nevertheless, this document does not disclose an inflatable foil. Balloons are not manufactured from aluminum foil.

WO 2007 098 168 describes a display to hold an inflatable balloon, which comprises a surface for writing on with a felt-tipped marker. In practice, however, the bonding time of the colorant is too long and the covering capacity is often poor, which leads to disappointing results.

It is clear that there remains a need in the art for improved coloring of sheets with coloring agents. Currently, these colorants dry slowly, make stains and are not correctable. This leads often to frustration and disappointment of children. Moreover, the stains made by the colorants are often persistent, hence parents often discourage the coloring of rubber balloons.

The present invention aims to resolve at least some of the problems mentioned above. The invention thereto aims to provide a coloring kit comprising an inflatable foil, suitable for coloring directly thereon, and a fast drying coloring agent with a high covering capacity. Moreover, the invention also discloses a method for coloring such inflatable foils.

SUMMARY OF THE INVENTION

The present invention provides a kit of playing materials according to claim 1.

The present invention may thereto be described by the following embodiments:

1. Kit comprising:
   - at least one inflatable foil, provided with a closable opening and suitable for receiving and containing a gas;
   - said foil comprising a colorable area which extends across at least part of the foil; and
   - at least one wax-based coloring agent, suitable for coloring said colorable area.
2. A kit according to embodiment 1, characterized in that the wax-based coloring agents are manufactured from materials comprising stearic acid, hydrogenated castor, nonyl phenyl ether, sodium laureth sulphate, talc, liquid paraffin oil and/or pigments.
3. Kit according to any of the preceding embodiments, characterized in that the foil comprises a non-metallized foil.
4. Kit according to preceding embodiment 3, characterized in that said non-metallized foil comprises a polyethylene and a polyamide layer, joined by an adhesive layer.
5. Kit according to preceding embodiment 4, characterized in that the said polyamide layer comprises biaxially oriented nylon.
6. Kit according to any of the previous embodiments, characterized in that said foil is provided with a valve system.
7. Kit according to any of the previous embodiments, characterized in that the foil comprises at least one welded seam.
8. Kit according to any of the previous embodiments, characterized in that the kit comprises a holding means to retain the balloon in inflated condition.
9. Kit according to any of the previous embodiments, characterized in that the foil is monochrome or polychrome.
10. Kit according to any of the previous embodiments, characterized in that the colorable area comprises a printed figure and/or text which is colorable.
11. Kit according to any of the previous embodiments, characterized in that the foil has a figurative shape, such as the shape of an animal, an object or a face.
12. Kit according to any of the previous embodiments, characterized in that the kit comprises a container comprising helium.
13. Kit according to any of the previous embodiments, characterized in that said kit comprises instructions with regard to the use of said foil and/or coloring agents.
14. Kit according to any of the previous embodiments, characterized in that said kit comprises holding means for holding an inflated foil.
15. Method for offering one or more colourable balloons, said method comprises preferably the following steps:

the provision of one or more waxed-based coloring agents and/or instructions regarding the use of suitable coloring agents; and the provision of one or more non-metallized foils, said foils comprising a colourable area extending over at least part of the surface of said foil.

DESCRIPTION OF FIGURES

In FIG. 1, an embodiment of a typical foil balloon (1) with a colorable area is presented. In current embodiment, the balloon has the shape of a rabbit. Nevertheless, it is clear that the foil balloon can adopt different shapes of animals, faces or objects. Some features, like the eyes and the mouth of the rabbit, were preprinted in the factory. Several areas are indicated, similarly as in coloring books, and can be colored with different wax crayons (2). The foil of the balloon is a non-metallized foil and can be efficiently colored with the wax crayons, which have a high covering capacity. Moreover, the coloring agent based on wax and pigments is drying instantaneously, avoiding stains on cloths or hands while manipulating the foil. Due to the properties of the foil and the coloring agent, the balloon can be inflated immediately after the coloring. Moreover, when inflated with helium through the valve (3), the balloon floats in the air. The inflated balloon can be guided in the air by means of a string or plastic bar. In a preferred embodiment, the valve of the balloon is resealable.

In FIG. 2, another possible embodiment of a foil balloon (1) is presented. The heart-shaped balloon has a preprinted image of a dogface, which can be colored with a coloring agent based on wax. A gas, like helium, can be introduced via an opening of the valve system (3). The inflated balloon can be supported by a holding means (4), like a plastic bar or a string.

Figure 1:
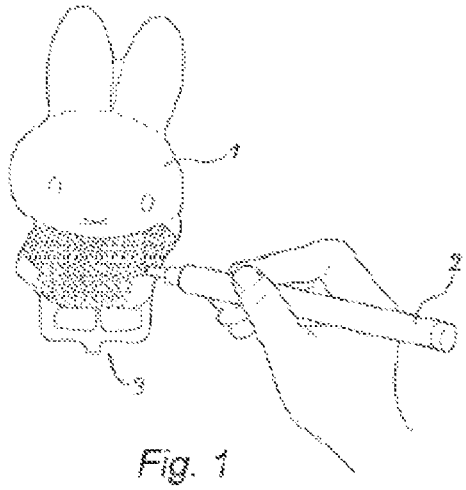
FIGS. 1 and 2 show embodiments of foil balloons with a particular shape and a colorable area, covering the foil at least partially.
Figure 2:
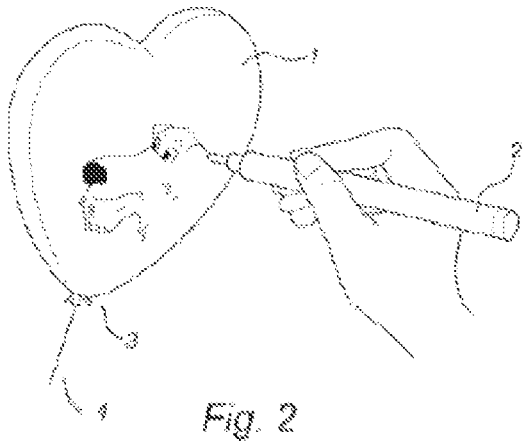

In what follows, an overview of the numbering used in the figures is given:

(1) non-metallized foil balloon;

(2) wax-based coloring agent;

(3) valve system;

(4) holding means.

DETAILED DESCRIPTION

The present invention concerns the coloring of inflatable sheets and, more particularly, the coloring of a foil balloon used as playing materials.

Unless otherwise defined, all terms used in disclosing the invention, including technical and scientific terms, have the meaning as commonly understood by one of ordinary skill in the art to which this invention belongs. By means of further guidance, term definitions are included to better appreciate the teaching of the present invention.

"A", "an", and "the" as used herein refers to both singular and plural referents unless the context clearly dictates otherwise. By way of example, "a compartment" refers to one or more than one compartment.

In a first aspect, the invention provides a kit, comprising at least one inflatable foil and at least one wax-based coloring agent. The foil is provided with a closable opening and is suitable for receiving and containing a gas such as air or helium and for forming a balloon. The foil further comprises a colourable area, which extends across at least part of the foil and which is suitable for the direct application of the coloring agents thereon. No intermediate material between the foil and the coloring agent is necessary, improving the appearance and appeal of said foil balloons. The colourable area is an integral part of the foil. Therefore, the excellent adhesion properties of wax are indispensable. In a further preferred embodiment, the colourable area is marked by lines or printed ink. Another advantage of the wax-based coloring agents is the high covering capacity of the dye. The inventors of current invention performed several tests with a series of coloring agents. Pencils with a clay binder have too low adhesion values. Moreover, the sharp tip of a pencil can pierce the foil of the balloon, inhibiting later inflation. Felt-tipped markers with a coloring agent based on water or alcohol are not convenient either, because the drying time is too long. Moreover, the felt-tipped markers can leave stains on both fabric of clothes and skin. Furthermore, alcohol-based agents are irritating for the skin, which is another serious drawback for this type of coloring agent. Oil-based crayons do not adhere on the balloons and are thus inappropriate. Therefore, the properties of the wax-based crayons are best-fit for coloring the foil of sheet balloons.

In an embodiment according to the invention, the coloring agent is wax-based. With the term "wax-based" is understood a coloring agent, such as a crayon, which is at least partially comprised of one or more waxes. Said waxes may be synthetic waxes or natural waxes or mixtures thereof. Waxes are a class of chemical compounds that are malleable near ambient temperatures. They are also a type of lipid. Characteristically, they melt above 45° C. to give a low viscosity liquid. Waxes are insoluble in water but soluble in organic, non-polar solvents. All waxes are organic compounds, both synthetically and naturally occurring. Waxes consist of long alkyl chains. Natural waxes may contain esters of carboxylic acids and long chain alcohols or mixtures of substituted hydrocarbons, such as long chain fatty acids and primary alcohols. Synthetic waxes are long-chain hydrocarbons lacking functional groups.

In a preferred embodiment, the wax-based coloring agent is manufactured from materials comprising stearic acid, hydrogenated castor, nonyl phenyl ether, sodium laureth sulphate, talc, liquid paraffin oil and/or pigments. These pigments can be natural or superficial. In a set of the coloring agents, different colours based on different pigments can be included. Moreover, the colors of the wax-based coloring agents are miscible with water. Finally, these wax-based coloring agents are environmentally friendly, sustainable and biodegradable.

In a preferred embodiment of the invention, the foil comprises a non-metallized foil. The inventors performed a series of tests in the quest for the foil with the best properties to be colored. From these tests, it turned out that metallized foils (although workable) are less suitable to be coloured, because the coloring agents described above do not optimally adhere to the foil. Non-metallized polymer foils are preferred as they allow coloring with wax-based crayons directly on such foil. The possibility of the direct coloring on the foil makes the use of an intermediate material, to make the balloon colourable (cf. the paper layer of U.S. Pat. No. 7,335,083), superfluous. The omission of the intermediate material improves the aesthetics of the balloon and it makes the balloon lighter, hence it will float in the air more easily.

In a preferred embodiment, said non-metallized foil comprises a polyethylene and a polyamide layer, joined by an adhesive layer. In a further preferred embodiment, the ground layer comprises extruded low-density polyethylene (LDPE) and has a thickness between 11 micron and 17 micron, preferentially 13.8 micron. The ground layer has a density between 11 g/m$^2$ and 15 g/m$^2$, preferentially about 13.3 g/m$^2$. A second layer comprises an adhesive, applied with a thickness of about 1 micron and with a density of about 1 g/m$^2$. The third layer is manufactured from materials comprising bi-axially oriented polyamide (BOPA) film. The BOPA film has a thickness between 10 micron and 14 micron, preferentially about 12 micron, and a density between 12 g/m$^2$ and 16 g/m$^2$, preferentially about 13.8 g/m$^2$. Finally, a top layer of inks is applied on the foil, preferentially non-toxic inks. The ink layer has a thickness between 0.5 micron and 1.5 micron, preferentially about 1 micron, and a density between 1 g/m$^2$ and 1.5 g/m$^2$, preferentially about 1.25 g/m$^2$. The combination of these layers provides a light-weight foil with a nominal thickness of about 27.8 micron, which proved to be excellent for the manufacture of balloons with decorations. The foil has a density of about 10.2 g/m$^2$ and a bond strength higher than 1000 g/in. The foil proved to be air-tight, hence the escape of helium from an inflated balloon is negligible and the resulting balloon floats when filled with helium due to the light-weight foil. Moreover, due to its inelastic properties, the images printed on the balloons maintain their natural shapes. In a preferred embodiment, the foil balloon has a diameter between 1 inch and 60 inch, preferentially between 8 inch and 35 inch, more preferably about 18 inch.

In a further preferred embodiment, the bi-axially oriented polyamide comprises bi-axially oriented nylon, which proved to have particularly interesting properties, like an excellent floating capacity and a good bond strength.

In an embodiment of the invention, the foil is provided with a valve system, necessary for the inflation of the balloon with air or gas. After inflation, a fastener comprised in the valve system can be closed, prohibiting the escape of the air or gas from the foil.

In a preferred embodiment, the valve system comprises a valve which is resealable. This allows to release the air or gas contained by the foil after inflation. The need for color corrections is sometimes only apparent when the balloon was inflated with gas. The resealable valve permits to release the gas contained by the inflated balloon. Thereafter, the coloring of the foil can be easily improved to provide the finishing touch. Once the desired result was obtained, the balloon can be inflated again and the valve can seal the foil.

In an embodiment of the invention, the foil, once inflated with helium, has a lower density than air, i.e. lower than about 1.29 kg/m$^3$. In an alternative embodiment, in which the valve system is manufactured of materials with a higher density than the foil, the combined density of the foil, the valve system and the helium in the balloon is smaller than the density of air. As a consequence, the balloon floats in the air when filled with helium. For the floating properties of the balloon, it is also essential no extra materials with a density higher than that of air need to be provided in order to make the balloon colorable.

In an embodiment of the current invention, the foil comprises at least one welded seam. As a result, the foil is hermetically closed and different shapes of balloons can be easily produced.

In an embodiment of the current invention, the kit comprises a holding means to retain the balloon in inflated condition. The balloons inflated with helium can float in the air. To prevent the loss of the balloon, the kit provides a holding means, which can be attached to and detached from the balloon. Said holding means can comprise a string or a plastic bar.

In an alternative embodiment multiple colorable foil balloons can be combined to form a multi-balloon. As such the multi-balloon can form more complicated and extended decorations. The holding means can be adapted to retain several balloons.

In a preferred embodiment of the invention, the foil is monochrome or polychrome. Monochrome foils can be more challenging and allow more freedom to color. These foils can be suitable for older children. Nevertheless, polychrome foils can draw the attention of and are more attractive for smaller children.

In a preferred embodiment of the invention, the colorable area comprises a printed figure and/or text, intended to color in with the wax-based coloring agents. Said preprinted shapes facilitate a beautiful result and therefore enhance the user experience. Moreover, children are attracted to well-known shapes or figures, for example from fantasy movies. As another application, text can be printed on the balloon, for example to wish somebody a happy birthday or a happy new year. In a further preferred embodiment of the current invention, the printed figure and/or text is monochrome or polychrome.

In a preferred embodiment of the invention, the foil has a particular shape, e.g. in the form of an animal, an object or a face. The shapes of the balloons can attract the attention of people, with similar arguments as used above. Balloons with particular shapes are sold more frequently, which is a clear advantage of such balloons.

In another preferred embodiment, the coloring agent can be corrected after coloring the foil. The colorization of the wax-based crayons can be removed by means of a wet cloth. Therefore, mistakes can be arranged, which is particularly important when children are coloring the balloons. Moreover, after one individual has coloured the balloon, the colour can be completely removed from the balloon and the balloon can be reused and recoloured by a second individual. The multiple use of the same balloon is both sustainable and cost-efficient.

Preferably said kit may be provided with instructions on the use of the foil and the coloring agents. These instructions may include information on the requirements of the coloring agents, safety instructions, instructions regarding the inflation of the foil and the use of suitable gases. Said instructions may also comprise guidelines for suitable decorations, possible prints and/or coloring patterns, etc. Said instructions may also comprise information on a corresponding website, where additional information may be found, as well as tools to send in pictures of the colored balloon, etc.

In a preferred embodiment of the kit disclosed in this document, the kit can comprise a container comprising helium. This container is provided by means to connect the valve system of the foil with the container, in order to fill the foil with the helium from the container. The inclusion of the container in the kit ensures that all users are able to inflate the balloon and allows floating of the balloon in the air. This way, all features of the foil can be fully exploited by all users of the colourable balloon.

Said kit may be provided with holding means for the inflated balloon. Said holding means may comprise for instance a cup for holding the balloon and a stick, which is suitable to engage with said cup and is designed to hold the inflated balloon in the air. Other holding means may comprise a ribbon, a band, a tape, or a cord.

In a further preferred embodiment, the kit comprises decoration elements, comprising stickers, glitter and glue, etc. These decoration elements can for example form the ears, eyes or mouth of an animal, represented by the balloon.

In an embodiment of the current invention, the kit further comprises a polymer tray and a cardboard box for packaging. In a preferred embodiment, the polymer tray comprises polystyrene.

In a second aspect of the invention, this document discloses a method for colouring an inflatable foil as well as a method for offering one or more colourable balloons. Said method comprises preferably the following steps:

the provision of one or more waxed-based coloring agents and/or instructions regarding the use of suitable coloring agents; and the provision of one or more non-metallized foils, said foils comprising a colourable area extending over at least part of the surface of said foil.

Colouring agents and foils may be provided together in a kit, or separate in refill packs, whereby said refill pack is preferably provided with instructions regarding the use of the components and the requirements of for instance the coloring agents.

By preference, the foil and coloring agents comprise the characteristics as described above.

In a further embodiment, means for inflating said foils may be provided as well. Such means may comprise helium or air. Said means may be provided in a container.

In its inflated form, the particular shape of the balloon is best appreciated. By use of helium, the balloon will be able to float in the air, which maximizes the attractiveness of the product.

After inflation, the foil is closed by means of a valve system in order to prevent the loss of pressure. In this manner, both the shape and floatability of the balloon are maintained.

The invention is further described by the following non-limiting examples which further illustrate the invention, and are not intended to, nor should they be interpreted to, limit the scope of the invention.

The present invention will be now described in more details, referring to examples that are not limitative.

It is supposed that the present invention is not restricted to any form of realization described previously and that some modifications can be added to the presented example of fabrication without reappraisal of the appended claims.

What is claimed is:

1. A kit comprising:

one or more balloons, each balloon consisting of a non-metallized foil, wherein said balloon is provided with a closable opening and is suitable for receiving and containing a gas, wherein said foil comprises a colorable area which is integrally part of said foil; and at least one wax-based coloring agent, suitable for coloring said foil.

2. The kit according to claim 1, wherein the wax-based coloring agent is manufactured from materials comprising stearic acid, hydrogenated castor, nonyl phenyl ether, sodium laureth sulphate, talc, liquid paraffin oil and/or pigments.

3. The kit according to claim 2, wherein said non-metallized foil comprises a polyethylene and a polyamide layer, joined by an adhesive layer.

4. The kit according to claim 3, wherein said polyamide layer comprises bi-axially oriented nylon.

5. The kit according to claim 1, wherein said foil is provided with a valve system.

6. The kit according to claim 1, wherein the foil comprises at least one welded seam.

7. The kit according to claim 1, wherein the kit further comprises holding means to retain the balloon in inflated condition.

8. The kit according to claim 1, wherein the foil is monochrome or polychrome.

9. The kit according to claim 1, wherein the colorable area comprises a printed figure and/or text which is colorable.

10. The kit according to claim 1, wherein the foil has a figurative shape.

11. The kit according to claim 10, wherein the figurative shape is selected from the group consisting of an animal, an object and a face.

12. The kit according to claim 1, wherein the kit further comprises a container comprising helium.

13. The kit according to claim 1, wherein said kit further comprises instructions with regard to the use of said foil and/or coloring agents.

14. The kit according to claim 1, wherein said kit further comprises holding means for holding an inflated foil.

* * * * *